US006010970A

United States Patent [19]

McGinty et al.

[11] Patent Number: 6,010,970

[45] Date of Patent: Jan. 4, 2000

[54] FLASH-SPUN SHEET MATERIAL

[75] Inventors: David Jackson McGinty; Stasys K. Rudys, both of Midlothian; David M. Harriss, Chesterfield, all of Va.

[73] Assignee: E.I. du Pont de Nemours and Company, Wilmington, Del.

[21] Appl. No.: 09/035,143

[22] Filed: Mar. 5, 1998

Related U.S. Application Data

[63] Continuation-in-part of application No. 08/811,645, Mar. 5, 1997, abandoned.

[51] Int. Cl.[7] ..... B32B 5/16

[52] U.S. Cl. ..... 442/365; 442/334

[58] Field of Search ..... 442/334, 336, 442/340, 365, 401, 409, 417

[56] References Cited

U.S. PATENT DOCUMENTS

| | | | |
|---|---|---|---|
| 3,081,519 | 3/1963 | Blades et al. | 28/81 |
| 3,169,899 | 2/1965 | Steuber | 161/72 |
| 3,227,784 | 1/1966 | Blades et al. | 264/53 |
| 3,227,794 | 1/1966 | Anderson et al. | 264/205 |
| 3,427,376 | 2/1969 | Dempsey | 264/282 |
| 3,478,141 | 11/1969 | Dempsey et al. | 264/284 |
| 3,532,589 | 10/1970 | David | 161/150 |
| 3,860,369 | 1/1975 | Brethauer et al. | 425/3 |
| 4,013,617 | 3/1977 | Gordon et al. | 260/42.55 |
| 4,069,078 | 1/1978 | Marder et al. | 156/181 |
| 4,554,207 | 11/1985 | Lee | 428/288 |
| 5,603,885 | 2/1997 | McGinty | 264/205 |

FOREIGN PATENT DOCUMENTS

| | | | |
|---|---|---|---|
| 0 036 593 | 9/1981 | European Pat. Off. | A21D 13/08 |
| 891943 | 3/1992 | United Kingdom . | |
| WO 95/23192 | 8/1995 | WIPO | C09C 1/36 |

*Primary Examiner*—Christopher Raimund

[57] ABSTRACT

Improved sheets of bonded plexifilamentary film-fibril strands spun from a polyolefin and a pigment are provided. The polyolefin comprises at least 90% by weight of the fibril strands, and the pigment comprises between 0.05% and 10% by weight of the fibril strands. The sheet has a high opacity and high smoothness, even when the sheet is bonded to a delamination strength greater than 120 N/m or when subjected to calendering. The sheet material is highly printable.

9 Claims, 6 Drawing Sheets

FLASH-SPUN SHEET MATERIAL

This is a continuation-in-part of application Ser. No. 08/811,645 filed Mar. 5, 1997, now abandoned.

FIELD OF THE INVENTION

This invention relates to sheets made from plexifilamentary film-fibril strands flash-spun from a polymer. More particularly, the invention relates to plexifilamentary sheets wherein the physical properties of the sheets are improved by adding small amounts of pigment to the polymer prior to flash-spinning.

BACKGROUND OF THE INVENTION

The art of flash-spinning plexifilamentary film-fibrils from a polymer in a solution or a dispersion is known in the art. The term "plexifilamentary" means a three-dimensional integral network of a multitude of thin, ribbon-like, film-fibril elements of random length and with a mean thickness of less than about 4 microns and with a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form the three-dimensional network.

The process of forming plexifilamentary film-fibril strands and forming the same into non-woven sheet material has been disclosed and extensively discussed in U.S. Pat. No. 3,081,519 to Blades et al.; U.S. Pat. No. 3,227,794 to Anderson et al.; U.S. Pat. No. 3,169,899 to Steuber; and U.S. Pat. No. 3,860,369 to Brethauer et al. (all of which are assigned to E. I. du Pont de Nemours and Company ("DuPont")). This process and various improvements thereof have been practiced by DuPont for a number of years in the manufacture its Tyvek® spunbonded olefin.

The general flash-spinning apparatus shown in FIG. 1 is similar to that disclosed in U.S. Pat. No. 3,860,369 to Brethauer et al., which is hereby incorporated by reference. According to the flash-spinning process, a mixture of polymer and spin agent is provided through a pressurized supply conduit 13 to a spinning orifice 14. The polymer mixture in chamber 16 is discharged through a spin orifice 14 where extensional flow near the approach of the orifice helps to orient the polymer into elongated polymer molecules. When polymer and spin agent discharge from the orifice, the spin agent rapidly expands as a gas and leaves behind fibrillated plexifilamentary film-fibrils. The spin agent's expansion during flashing accelerates the polymer so as to further stretch the polymer molecules just as the film-fibrils are being formed and the polymer is being cooled by the adiabatic expansion. The quenching of the polymer freezes the linear orientation of the polymer molecule chains in place, which contributes to the strength of the resulting flash-spun plexifilamentary polymer structure.

The polymer strand 20 discharged from the spin orifice 14 is directed against a rotating lobed deflector baffle 26 that spreads the strand 20 into a more planar web structure 24, and alternately directs the web to the left and right as the web descends to a moving collection belt 32. The web forms a fibrous batt 34 that is passed under a roller 31 that compresses the batt into a sheet 35 formed with plexifilamentary film-fibril networks oriented in an overlapping multi-directional configuration. The sheet 35 exits the spin chamber 10 through the outlet 12 before being collected on a sheet collection roll 29. The sheet 35 may be thermally bonded in order to obtain desired sheet strength, opacity, moisture permeability and air permeability.

The polymers that have been conventionally used in production of flash-spun plexifilamentary sheets are polyolefins, especially polyethylene. British Patent Specification 891,943 (assigned to DuPont) discloses that additives, including colored pigments, can be added to the polymeric material used in producing flash-spun plexifilamentary fibers. U.S. Pat. No. 3,169,899 (assigned to DuPont) suggests that flash-spun polymer with various additives, including pigments, may be used in producing plexifilamentary sheet material. However, this prior art does not disclose or suggest how pigments might be used to produce sheet material with improved physical properties or what the properties of such sheet material might be.

It has been found that the delamination strength of a flash-spun polyethylene sheet of a given basis weight can be significantly increased by increasing the amount of thermal bonding to which the sheet is subjected. However, the opacity of flash-spun plexifilamentary sheets decreases with increased amounts of thermal bonding. Reduced opacity gives many highly bonded sheets a flimsy and mottled appearance, even though such sheets may actually have a higher strength than less bonded sheets. Reduced opacity may also cause quicker degradation of sheet strength in the presence of ultraviolet light, such as sunlight, because more light passes through a less opaque sheet. In addition, when a less opaque sheet is printed, the printed matter is much more difficult to read than printed matter on a sheet with higher opacity. The traditional tradeoff between delamination strength and sheet appearance has been troublesome in a number of the end use applications for flash-spun sheet material, including sterile packaging, maps and envelopes.

When used as a sterile packaging material, flash-spun sheet material is made into packaging for items that require sterilization, such as surgical instruments. An item is placed in a pouch or other package made of flash-spun sheet material, which package is then sealed and sterilized. The package seal is subsequently opened to remove the sterilized item. When the sterilized item is something like a surgical instrument, it is extremely important that the sheet not tear or delaminate when opened because this would generate particulates that could deposit on the instruments. Resistance to delamination can be increased by increasing the amount of bonding to which the sheet is subjected. However, when a lower basis weight sheet material is heavily bonded, the sheet takes on a translucent and mottled appearance that makes users question the sterility of items stored in such material. In the past, sheets with basis weights higher than what is needed for strength and bacterial barrier properties have been used in sterile packaging in order to provide a desired level of opacity. A flash-spun sheet material is needed that can be used at lower basis weights than the sheet material currently used in sterile packaging, yet can be thermally bonded to the degree necessary to obtain the requisite delamination strength without taking on an unacceptable translucent and mottled appearance.

Another end use in which high opacity, good visual uniformity and high delamination strength of a bonded flash-spun plexifilamentary sheet offers great advantages is for printed materials, such as maps and tags. Certain maps, such as marine maps and military maps, need to be durable under a variety of adverse conditions. Maps printed on bonded flash-spun sheet material have been found to be offer such durability. Because the users of such maps frequently plot courses on the maps and later erase the course markings, the maps must resist abrasion-induced delamination and scuffing of the surface. This abrasion resistance is best achieved by increasing the degree of sheet bonding. In addition, flash-spun plexifilamentary sheet material can be more readily printed if it has a smooth surface. A bonded plexifilamentary sheet material can be made smoother by passing the sheet between smooth thermal calender rolls. At the same time, high sheet opacity is needed if detailed printing is to be readable from the sheet on which a map is printed. Unfortunately, sheet opacity is normally reduced when a sheet is subjected to higher levels of bonding and/or to thermal calendering. In the past, the basis weight of plexifilamentary sheet material has been increased in order to meet the printing requirements of high sheet opacity, high delamination strength, and high sheet smoothness. However, heavier sheet material also makes for printed sheets that are heavier, bulkier and less flexible than is desirable.

Accordingly, there is a need for a plexifilamentary sheet that can be subjected to substantial thermal bonding and/or thermal calendering without undergoing a significant reduction in the opacity of the sheet. There is also a need for a sheet material that when printed is highly readable, even by bar code scanning equipment. Finally, there is a need for opaque plexifilamentary sheets that are colored and that exhibit a high degree of color saturation after thermal bonding.

SUMMARY OF THE INVENTION

There is provided by the present invention improved sheets of plexifilamentary film-fibril strands spun from a fiber-forming semi-crystalline polyolefin. The nonwoven fibrous sheet is comprised of continuous lengths of bonded plexifilamentary fibril strands of a polyolefin polymer and a pigment wherein the polyolefin comprises at least 90% by weight of the fibril strands, and the pigment comprises between 0.05% and 10% by weight of the fibril strands.

According to a preferred embodiment of the invention, the sheet has a basis weight of less than 130 g/m$^2$, a Parker Tester Smoothness of less than 4.8 microns, and an opacity of at least 92% if the sheet has a delamination strength less than 150 N/m, and an opacity of at least 80% if the sheet has a delamination strength greater than 150 N/m.

According to one preferred embodiment of the invention, the pigment in the sheet is titanium dioxide. Preferably, the titanium dioxide comprises particles of rutile titanium dioxide having an average particle size of less than 0.5 microns which particles are coated with an organosilicon compound. The sheet with titanium dioxide pigment preferably has a bar code readability grade, according to ANSI Standard X3.182-1990, of at least 2.0 (Grade C), and more preferably of at least 3.0 (Grade B), using Code 39 symbology with a narrow band width of 0.0096 inch (0.0244cm).

BRIEF DESCRIPTION OF THE DRAWINGS

A more thorough explanation of the invention will be provided in the detailed description of the preferred embodiments of the invention in which reference will be made to the following drawings.

DETAILED DESCRIPTION

Figure 1:
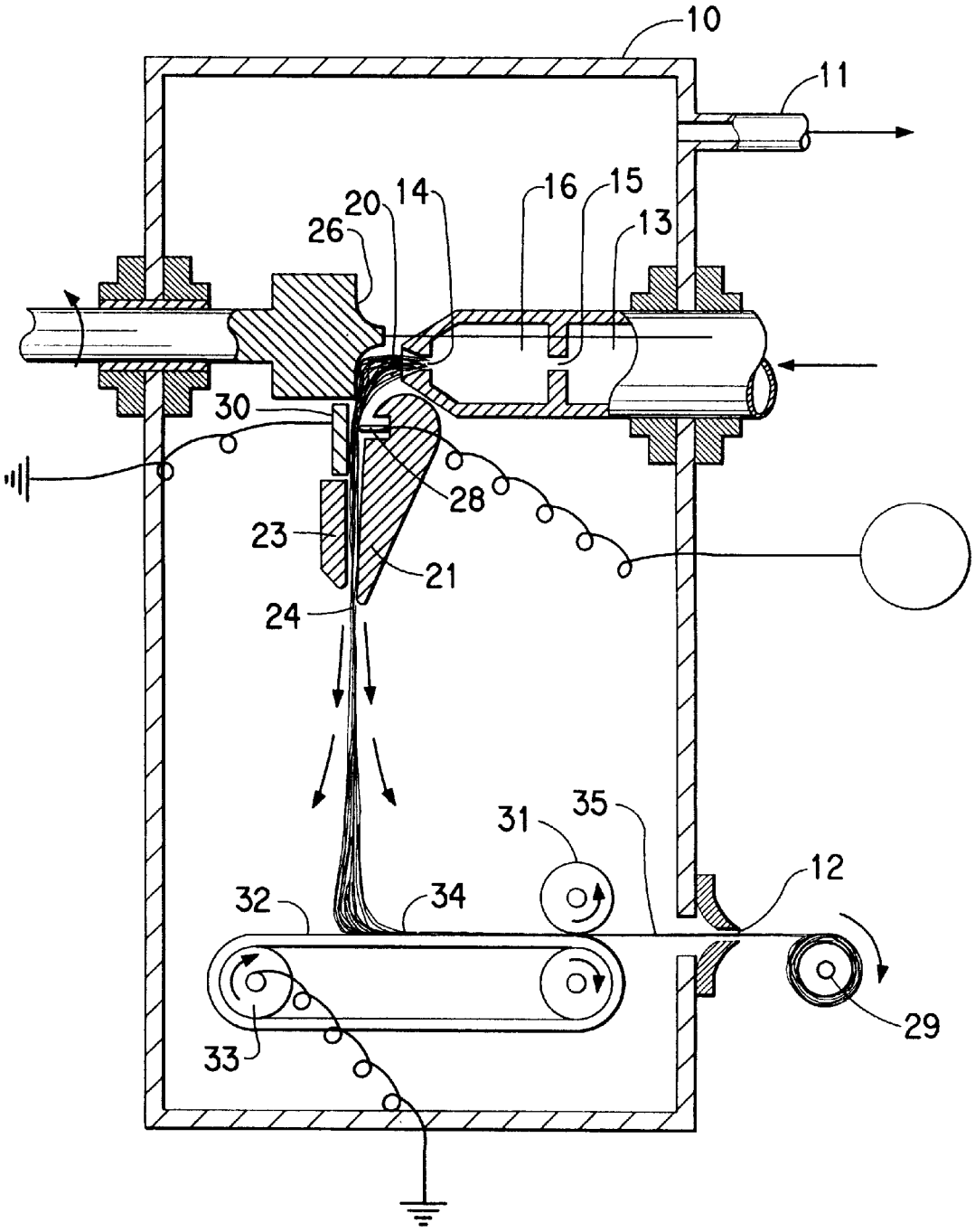
FIG. 1 (PRIOR ART)
FIG. 1 is a schematic drawing of an apparatus for flash-spinning polyolefin polymer into a plexifilamentary film-fibril web and laying down the web as a batt on a moving surface, which batt is consolidated to sheet form.

Referring now to FIG. 1, an apparatus and process for flash-spinning a thermoplastic polymer is illustrated. This flash-spinning process is known and it is carried out using standard equipment. The process is conducted in a chamber 10, sometimes referred to as a spin cell, which has a solvent-removal port 11 and an opening 12 through which non-woven sheet material produced in the process is removed. Polymer solution (or spin liquid) is continuously or batch-wise prepared at an elevated temperature and pressure in a mixing system or supply tank (not shown). The pressure of the solution is greater than autogenous pressure, and preferably greater than the cloud-point pressure for the solution. Autogenous pressure is the equilibrium pressure of the polymer solution in a closed vessel, filled with only solution having both liquid and vapor phases therein, and wherein there are no outside influences or forces. Autogenous pressure is a function of temperature. By providing the solution at greater than autogenous pressure, it is assured that the solution will not have any separate vapor phase present therein. The cloud-point pressure of the solution is the lowest pressure at which the polymer is fully dissolved in the solvent so as to form a homogeneous single phase mixture.

The polymer solution is admitted from the preparation tank through a pressurized supply conduit 13 and an orifice 15 into a lower pressure (or letdown) chamber 16. In the lower pressure chamber 16, the solution separates into a two-phase liquid-liquid dispersion, as is disclosed in U.S. Pat. No. 3,227,794 to Anderson et al. One phase of the dispersion is a solvent-rich phase comprising primarily solvent and the other phase of the dispersion is a polymer-rich phase containing most of the polymer. This two phase liquid-liquid dispersion is forced through a spinneret 14 into an area of much lower pressure (preferably atmospheric pressure) where the solvent expands and evaporates very rapidly (flashes), and the polyolefin emerges from the spinneret as a plexifilamentary strand 20. The strand 20 is directed against a rotating baffle 26. The rotating baffle 26 has a shape that transforms the strand 20 into a flatter web 24 of about 5–15 cm in width. The rotating baffle 26 directs the web 24 in a back and forth oscillating motion having sufficient amplitude to generate a 45–65 cm-wide swath on a laydown belt 32. The web 24 is laid down on the moving wire laydown belt 32 located about 50 cm below the rotating baffle 26, and the back and forth oscillating motion is directed generally across the belt 32 to form a batt 34.

After the web 24 is deflected by the baffle 26 on its way to the moving belt 32, the web enters a corona charging zone between a stationary multi-needle ion gun 28 and a grounded rotating target plate 30. The charged web 24 is carried by a high velocity solvent vapor stream through a diffuser consisting of a front section 21 and a back section 23. The diff-user controls the expansion of the spin agent gases and slows the web 24 down. The moving belt 32 is grounded through roll 33 so that the charged web 24 is electrostatically attracted to the belt 32 and is pinned in place thereon. Overlapping web swaths collected on the moving belt 32 are held there by electrostatic forces and are formed into the batt 34 with a thickness controlled by the spin liquid flow rate and the speed of belt 32. The batt 34 is compressed between belt 32 and consolidation roll 31 into a sheet 35 having sufficient strength to be handled outside the chamber 10 and collected on a windup roll 29.

Figure 2:
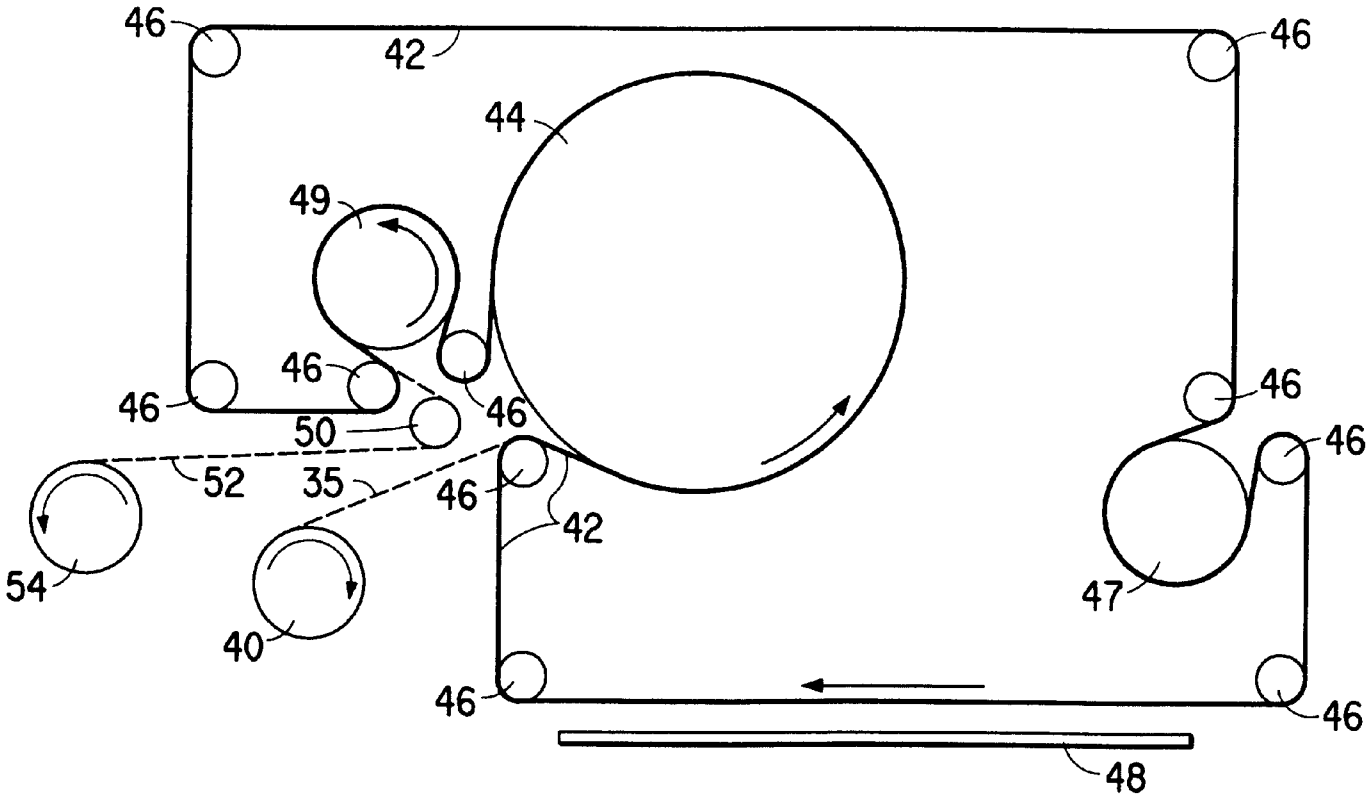
FIG. 2 (PRIOR ART)
FIG. 2 is a schematic drawing of an apparatus for bonding a plexifilamentary film-fibril sheet of flash-spun polyolefin polymer.

The lightly consolidated film-fibril sheet 35 is conventionally bonded according to a thermal bonding process like that disclosed in U.S. Pat. No. 3,532,589 to David (assigned to DuPont), and as shown in FIG. 2. According to this process, unconsolidated film-fibril sheet 35 from a supply roll 40 is subjected to light compression during heat bonding in order to prevent shrinkage and curling of the bonding sheet. A flexible belt 42 is used to compress sheet 35 as the sheet is bonded against a large heated drum 44 that is made of a heat-conducting material. Tension in the belt is maintained by the rolls 46. The belt is preheated by a heating roll 47 and/or a heated plate 48. The drum 44 is maintained at a temperature substantially equal to or greater than the upper limit of the melting range of the film-fibril elements of the sheet being bonded. The heated and bonded sheet 52 is removed from the heated drum 44 without removing the belt restraint and the sheet is then transferred to a cooling roll 49 where the temperature of the film-fibril sheet throughout its thickness is reduced to a temperature less than that at which the sheet will distort or shrink when unrestrained. Roll 50 removes the bonded sheet from the belt 42 before the sheet is collected on a collection roll 54. The temperature of the heated drum 44 and the belt 42, and the rotational speed of the drum 44 and belt 42 determine the amount of sheet bonding. The sheet may be run through another thermal bonding device like that shown in FIG. 2 with the opposite surface of the sheet facing the heated drum in order to produce a hard bonded surface on both sides of the sheet.

Alternatively, the lightly consolidated film-fibril sheet 35 may be point-bonded by passing the sheet between a heated roll with raised bosses and a resilient roll, as described in U.S. Pat. No. 3,478,141 to Dempsey et al. (assigned to DuPont). Where softer flash-spun sheet is desired, the point-bonded sheet may be softened by passing the sheet through a button breaking and creping device, as described in U.S. Pat. No. 3,427,376 to Dempsey et al. (assigned to DuPont).

Typical polymers used in the flash-spinning process are polyolefins, such as polyethylene and polypropylene. It is also contemplated that copolymers comprised primarily of ethylene and propylene monomer units, and blends of olefin polymers and copolymers could be flash-spun as described above. It has now been found that it is possible to make flash-spun polyolefin sheet material according to the processes described above, but with a small amount of pigment dispersed throughout the polymer. Such pigment has been found to increase the opacity of the flash-spun sheet, especially where the sheet is subjected to elevated levels of thermal bonding. It has also been found that the dispersion of certain pigments in a flash-spun polyolefin sheet make matter printed on such sheets more readable by both the human eye and electronic scanning equipment. Applicants have successfully made pigmented flash-spun polyolefin sheets that enjoy the above-described benefits using both white and colored pigments.

A white pigment that has been found to be an especially beneficial additive in flash-spun polyolefin sheets is titanium dioxide. The addition of a small amount of titanium dioxide to a polyolefin polymer prior to beginning flash-spinning according to the process described above has been found to significantly increase the opacity of the bonded flash-spun sheet. According to a preferred embodiment of the invention, a mixture of a polyolefin polymer and titanium dioxide is first formed wherein the titanium dioxide comprises between 0.1% and 10% by weight of the mixture, and more preferably from 1% to 5% by weight of the mixture. This mixture is combined with a solvent to form a spin solution at an elevated temperature and pressure. The pressure of the spin solution is greater than autogenous pressure, and preferably greater than the cloud-point pressure for the solution. The solvent preferably has an atmospheric boiling point between 0° C. and 150° C., and is selected from the group consisting of hydrocarbons, hydrofluorocarbons, chlorinated hydrocarbons, hydrochlorofluorocarbons, alcohols, ketones, acetates, hydrofluoroethers, perfluoroethers, and cyclic hydrocarbons (having five to twelve carbon atoms). Preferred solvents for solution flash-spinning polyolefin polymers and copolymers and blends of such polymers and copolymers include trichlorofluoromethane, methylene chloride, dichloroethylene, cyclopentane, pentane, HCFC-141b, and bromochloromethane. Preferred co-solvents that may be used in conjunction with these solvents include hydrofluorocarbons such as HFC-4310 mee, hydrofluoroethers such as methyl(perfluorobutyl)ether, and perfluorinated compounds such as perfluoropentane and perfluoro-N-methylmorpholine. This spin solution is subsequently flash-spun from a spin orifice and laid down on a moving belt to form sheets of plexifilamentary film-fibrils according to the flash-spinning process described above and shown in FIG. 1.

The preferred polyolefin in the mixture of titanium dioxide and polyolefin is polyethylene. The titanium dioxide is preferably added to the mixture in the form of particles having an average particle size of less than 0.5 microns. The titanium dioxide particles are first compounded into polyethylene at an on-weight-polymer loading of between 10% and 80% by weight to form a concentrate. The concentrate is next blended with a high density polyethylene, preferably having a melt index of between 0.65 and 1.0 g/10 minutes at 190° C. and a density of between 0.940 and 0.965 g/cc, such that the titanium dioxide comprises between 0.10% and 10% by weight of the mixture. This mixture of polyethylene and titanium dioxide is combined with a spinning solvent, as described above, prior to flash-spinning.

The titanium dioxide particles used in the invention are generally in rutile or anatase crystalline form, and the particles are commonly made by either a chloride process or a sulfate process. The titanium dioxide particles may also contain ingredients to improve the durability of the particles or the dispensability of the particles in the polymer. By way of example, and not limited thereto, the titanium dioxide used in the invention may contain additives and/or inorganic oxides, such as aluminum, silicon or tin as well as triethanolamine, trimethylolpropane, and phosphates. Preferably, the titanium dioxide particles have a coating of about 0.1% to about 5% by weight, based on the weight of the titanium dioxide, of at least one organosilicon compound, such as a silane or a polysiloxane to improve the stability of the mixture of polymer, titanium dioxide and spin agent. The preferred coating is a silane compound having the formula: $R_xSi(R')_{4-x}$ wherein: R is a nonhydrolyzable aliphatic, cycloaliphatic or aromatic group having 8–20 carbon atoms; R' is a hydrolyzable group selected from alkoxy, halogen, acetoxy or hydroxy or mixtures thereof, and x=1 to 3. Such titanium dioxide particles are more fully disclosed in PCT Patent Publication No. WO 95/23192m, which is hereby incorporated by reference. The titanium dioxide used in Examples 1 and 2 below was added to the polymer in the form of particles of neutralized pigmentary rutile titanium dioxide sprayed with 1% by weight of octyl triethoxy silane.

Figure 3:
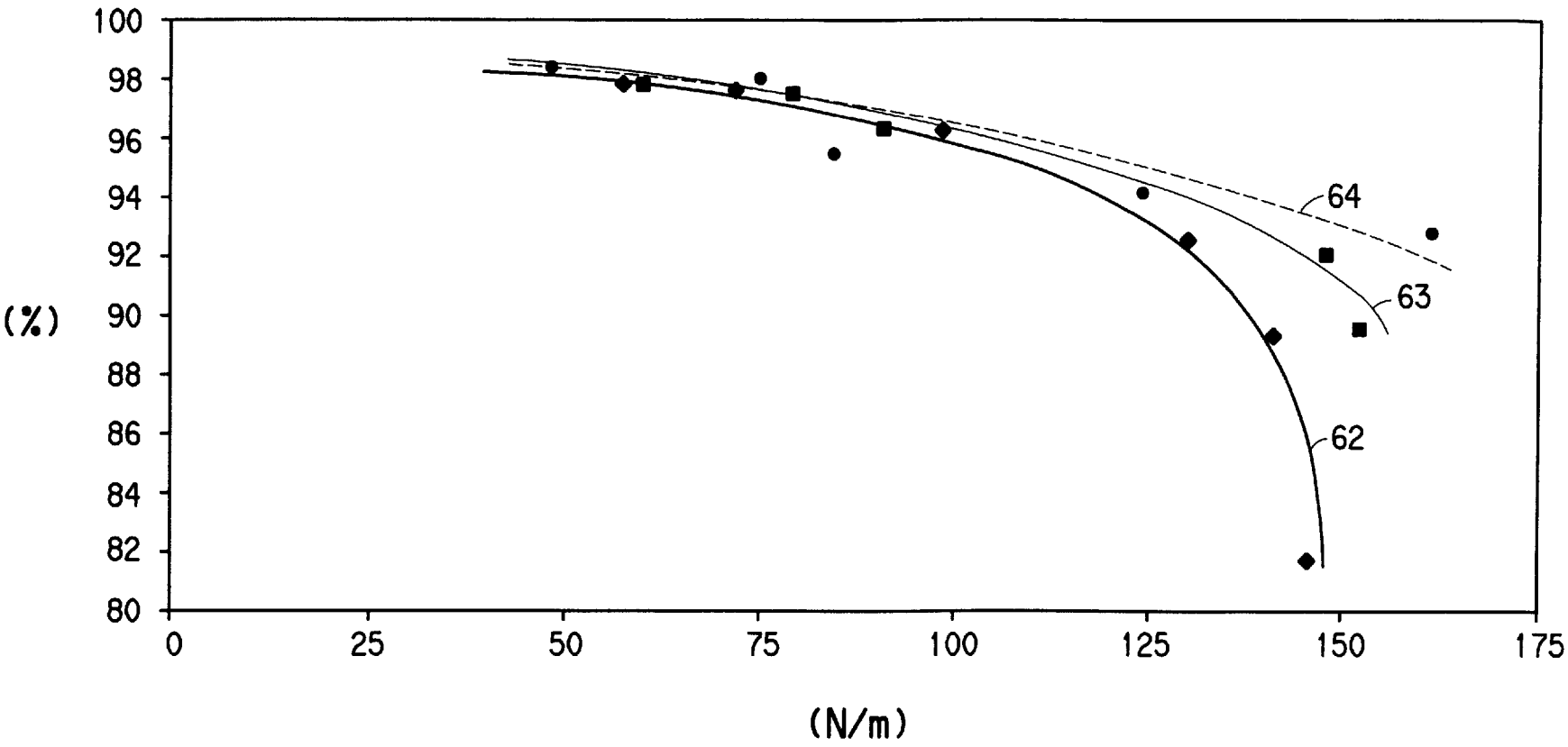
FIG. 3 is a graph showing opacity values for a number of different bonded sheets at various delamination strengths.

Flash-spun sheets of plexifilamentary film-fibrils of polyethylene and titanium dioxide have been found to exhibit a number of improved properties. For example, at most levels of sheet opacity, the delamination strength of a sheet that included small amounts of titanium dioxide was significantly greater than the delamination strength of a sheet that was identical, except that it was made without titanium dioxide. FIG. 3 is a graph of opacity vs. delamination strength for the three sheets produced as described in Comparative Example 1 and in Examples 1 and 2. The first sheet (curve 62) had no titanium dioxide added; the second sheet (curve 63) included 2.5% by weight of silane coated rutile titanium dioxide; and the third sheet (curve 64) included 5% by weight of silane coated rutile titanium dioxide. As can be seen in FIG. 3, at an opacity level of 93%, the sheet with no titanium dioxide had a delamination strength of about 125 N/cm, while the sheet with 2.5% titanium dioxide had a delamination strength of about 140 N/cm, and a sheet with 5% titanium dioxide had a delamination strength of about 165 N/cm. While the lightly bonded sheets with a delamination strength of about 60 N/m each maintained an opacity of about 98%, at a more bonded delamination strength of about 140 N/m, the sheet with 5% titanium dioxide maintained a 94% opacity while the sheet without titanium dioxide had maintained only a 89.5% opacity. This is because the titanium dioxide containing sheet material can withstand a greater degree of thermal bonding without undue reduction in opacity.

Figure 4:
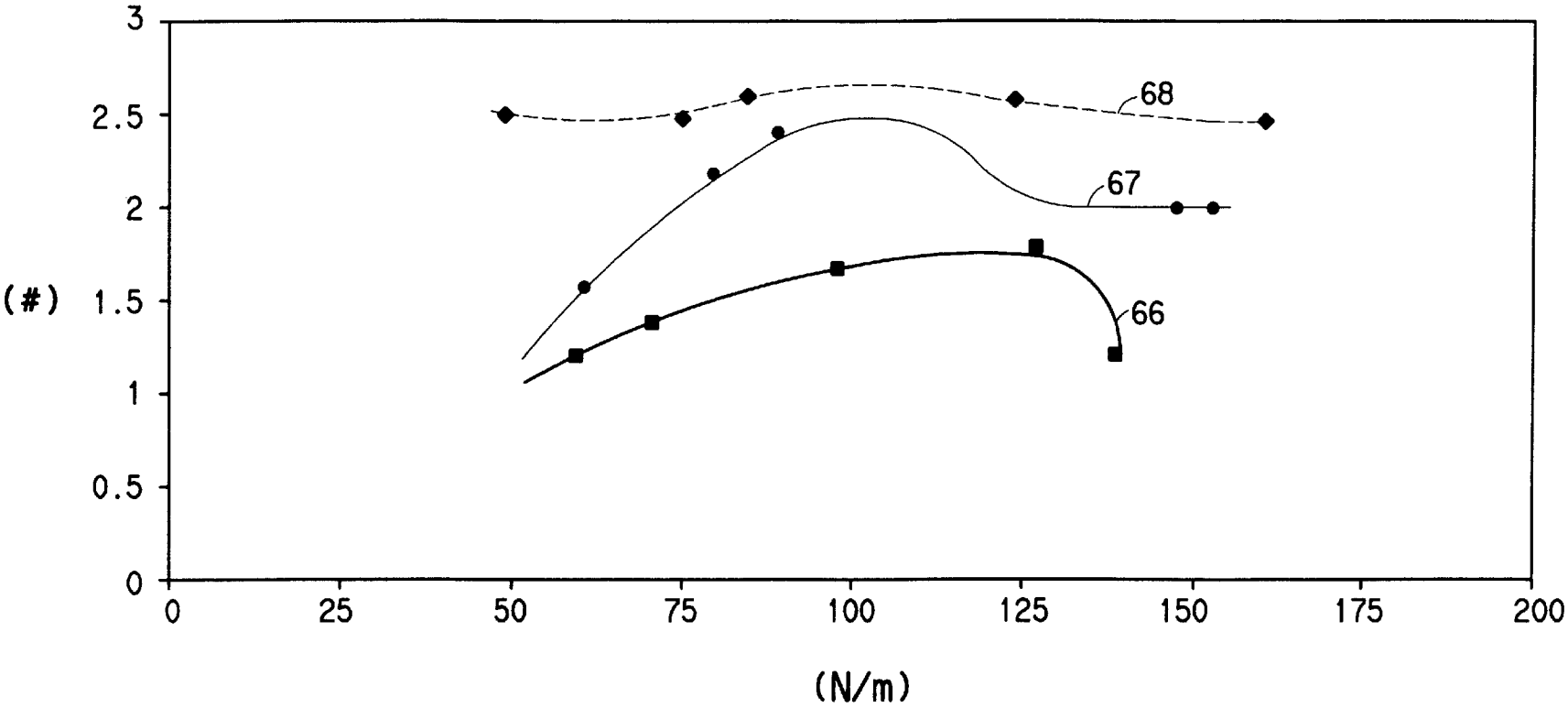
FIG. 4 is a graph showing the bar code quality values for a number of different bonded sheets at various delamination strengths.

Another marked advantage of sheets flash-spun from a mixture of polyethylene and a minor amount of titanium dioxide is that matter printed on such sheets is more readily discernible. For example, bar codes printed on sheet material that was made with small amounts of titanium dioxide (Examples 1 and 2) were far more readable by bar code reading machines than were the bar codes printed on sheet material that was made without titanium dioxide (Comparative Example 1). As can be seen in FIG. 4, the bar code readability scores for sheets made with either 2.5% titanium dioxide (curve 67) or 5% titanium dioxide (curve 68) were markedly higher than for sheets made without titanium dioxide (curve 66). At a given bonding level, the bar code readability scores for the sheet material with 5% titanium dioxide (Example 1) were, on average, 78% better than the readability scores for the sheet without titanium dioxide (Comparative Example 1). Likewise, the bar code readability scores for the sheet material with 2.5% titanium dioxide (Example 2) were, on average, 41% better than the readability scores for the sheet without titanium dioxide (Comparative Example 1). It is believed that this improvement results from two factors. First, the sheet with titanium dioxide reflects more light at the surface such that the contrast between the dark bars and the sheet is more pronounced. Second, because the sheet with titanium dioxide can be subjected to a greater degree of thermal bonding without significant loss of opacity, this sheet can be made with a smoother more reflective surface, which results in even greater visual contrast between the sheet and the printed matter. This improved readability is very beneficial when the sheet material is used for packaging, tags, or other items that are likely to be printed with bar codes.

Bonded plexifilamentary sheet material is more easily printed if the surface of the sheet is smooth. A smooth sheet surface requires far less ink than a rough surface because a smooth surface does not have pits and crevices that absorb significant quantities of ink as is the case with a rough or textured surface. Ink printed on a smooth surface stays at the surface where the ink makes the maximum contribution to the printed image. The thin and uniform layer of ink needed to produce an image on a smooth surface also dries faster, and is therefore more smudge resistant, than the thicker and less uniform layer of ink required to produce a printed image on a rough or textured surface.

Bonded plexifilamentary sheet material is not inherently smooth because such sheet material is made up of fine fibers with high surface areas that have been laid down on top of each other. In order to obtain a smooth readily printable surface on a sheet of bonded plexifilamentary sheet material it may be necessary to subject the sheet to higher temperature bonding. It has also been found that a highly printable smooth sheet surface can be obtained by passing the bonded sheet material between smooth calender rolls. However, when high bonding temperatures and/or post-bonding calendering is applied to plexifilamentary sheet material, the opacity of the sheet material goes down. As has been discussed above, printed matter on a less opaque sheet material is considerably less clear than matter printed on a more opaque sheet. Thus, much of the improvement in printability of a plexifilamentary sheet that can be obtained by making the surface smoother is lost due to reduced opacity.

It has now been found that another benefit of adding a small amount of pigment, such as titanium dioxide, to the polymer used in flash-spinning a plexifilamentary sheet material is that the sheet can be bonded and/or calendered to make the sheet smoother, and more printable, without sacrificing opacity. As can be seen in the Examples reported in Table 8 (Comparative Example 4, Example 8 and Example 11), the addition of titanium dioxide to the polymer used in making flash-spun plexifilamentary sheet material helps the sheet material maintain greater opacity when the sheet is subjected to cold calendering in order to improve sheet smoothness. Similarly, the Examples reported in Table 9 (Comparative Example 5, Example 9 and Example 12), demonstrate that the addition of titanium dioxide helps a plexifilamentary sheet material maintain greater opacity when the sheet is subjected to hot calendering in order to improve sheet smoothness. It can also be seen that both the cold calendered sheets to which titanium dioxide had been added of Examples 8 and 11 (Table 8) and the hot calendered sheet to which titanium dioxide had been added of Examples 9 and 12 (Table 9) were far more bar code scanable than the sheets without titanium dioxide (Comparative Examples 4 and 5). In Examples 13–21 it can be seen that the improved sheet opacity and bar code scanability that has be found to be result from the addition of titanium dioxide to a plexifilamentary sheet are evident over a range of sheet basis weights.

It has been found that colored pigments can also be used to improve the physical properties of bonded sheets of flash-spun plexifilamentary film-fibrils. A small amount of certain concentrated color pigments can increase a flash-spun sheet's opacity, improve the sheet's stability to UV radiation, and/or improve the sheet's visual uniformity. According to a preferred embodiment of the invention, a concentrate of a color pigment in a polymer is dispersed in polyethylene that is to be flash-spun. Preferably, the concentrate is a mixture of a polyethylene and color pigment in which the color pigment comprises between 5% and 60% by weight of the concentrate. Pellets of the concentrate and the polyethylene are introduced into the solutioning system by loss-in-weight feeders in a controlled manner such that the pigment comprises from 0.05% to 5.0% by weight of the polymer that is to be flash-spun. The mixture of polyethylene and color pigment is combined with one of the solvents described above to form a spin solution at an elevated temperature and pressure. This spin solution is subsequently flash-spun from a spin orifice and laid down to form sheets of plexifilamentary film-fibrils according to the flash-spinning process described above and shown in FIG. 1.

Color pigments used in flash-spinning should not be pigments that react with the spin agent. For example, color pigments that are unstable in acid environments should not be used with trichlorofluoromethane spin agents that are commonly used in flash-spinning high density polyethylene. One such color pigment that has been found to be unstable in trichlorofluoromethane spin agent is Ampacet's ultramarine blue (CI No. 77007). The color pigment must also be one that does not degrade at the elevated temperatures commonly applied to the spinning solution during solution flash-spinning of polyolefins (e.g., 180° to 20° C. for polyethylene). It is also important that the color pigment not destabilize the polymer, either during flash-spinning or in the finished sheet product. For example, pigments made with transition metals, as found in inorganic complex pigments like barium red pigment, have been found to promote oxidative degradation of flash-spun polyethylene sheet.

Figure 5:
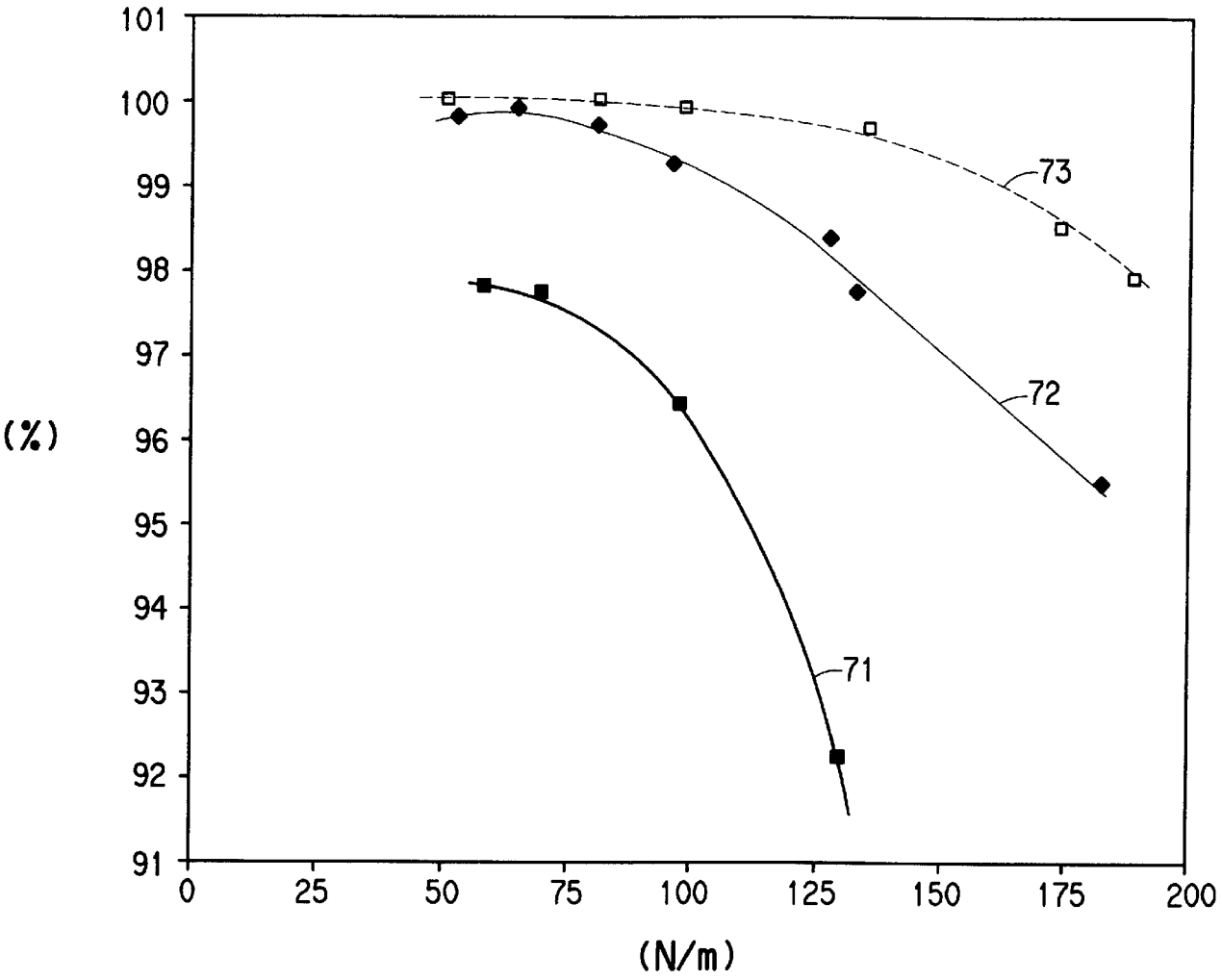
FIG. 5 is a graph showing opacity values for a number of different bonded sheets at various delamination strengths.

Bonded sheets into which the color pigments have been incorporated have been found to exhibit opacity after thermal bonding that is far superior to the opacity of a bonded sheet that is identical except for the absence of a pigment additive. As can be seen in FIG. 5, flash-spun polyethylene sheets that were produced with about 0.4% blue pigment (curve 73), as described in Example 3, or about 1.64% red pigment (curve 72), as described in Example 4, had opacities that remained above 98% even after the sheets were steam bonded to a delamination strength of up to 125 N/m. The opacity of the unpigmented sheet of Comparative Example 1 (curve 71) dropped to 91% when bonded to a delamination strength of 125 N/m. FIG. 5 shows that a high delamination strength can be achieved in the pigmented sheets made with a very small amount of color pigment with almost no loss in opacity.

Another surprising finding has been the degree to which color richness and color saturation in a sheet of flash-spun pigmented sheet product improves when the pigmented sheet of the invention is thermally bonded. Color saturation is one of the three attributes of color commonly used to characterize a color. In a three-dimensional color system, such as the Munsell System of Color Notation, color can be defined in terms of lightness, hue and saturation. According to this system, lightness from black to white is reported on a vertical axis. The hue is reported in terms of a direction perpendicular to the vertical axis which corresponds to a particular color on a hue circle that surrounds the vertical axis. The saturation of the color is reported in terms of a distance from the vertical axis. Colors that are further from the black-white vertical axis are less gray and are more saturated with the pure color hue. This degree of color saturation is not dependent on hue, and is expressed in the unitless measure of chroma.

Figure 6:
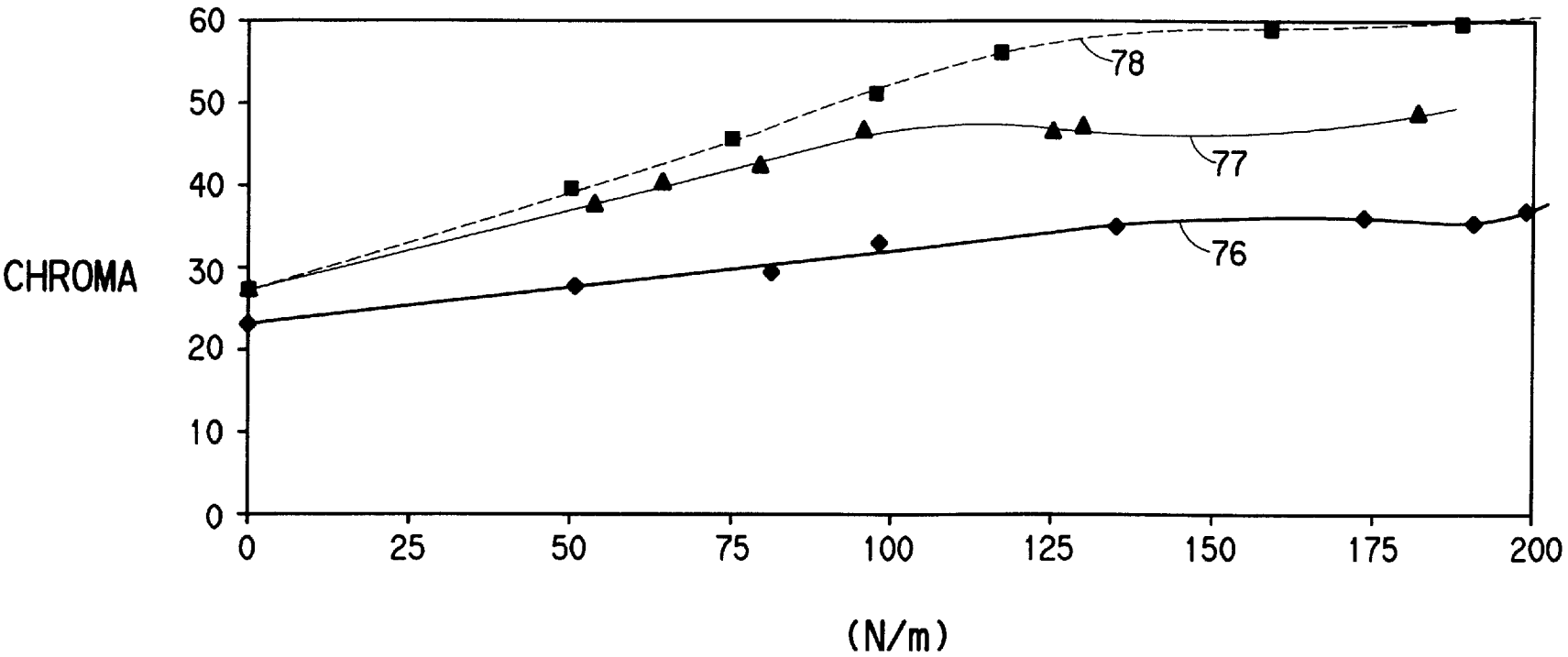
FIG. 6 is a graph showing chroma color saturation values for a number of different bonded sheets at various delamination strengths.

As can be seen in FIG. 6, the chroma of flash-spun polyethylene sheets that were produced with about 0.4% blue pigment (curve 76), as described in Example 3, about 1.64% red pigment (curve 77), as described in Example 4, or about 1.0% yellow pigment (curve 78), as described in Example 5 had chroma values that increased from 20% to 40% when bonded to a relatively low delamination strength of about 50 N/m. The chroma values for the sheets when bonded to delamination strengths greater than 150 N/m were from 60% to 105% greater than the chroma values for the corresponding unbonded sheets.

It has also been found that bonded flash-spun polyethylene sheet made with either white pigment, colored pigment, or some combination of the two has a much more uniform overall appearance in which the swirl patterns of the plexifilamentary web was much less visible than in comparable unpigmented sheet material. In many end use applications, this more uniform appearance makes it possible to use a lower basis weight sheet that can be made using less polymer.

The improved properties that are realized with the present invention are made more apparent in the following non-limiting examples.

EXAMPLES

In the description above and in the non-limiting examples that follow, the following test methods were employed to determine various reported characteristics and properties. ASTM refers to the American Society for Testing and Materials, TAPPI refers to the Technical Association of the Pulp and Paper Industry, ISO refers to the International Organization for Standardization, and ANSI refers to the American National Standards Institute.

Basis Weight was determined by ASTM D-3776, which is hereby incorporated by reference, and is reported in $g/m^2$. The basis weights reported for the examples below are each based on an average of at least twelve measurements made on the sheet.

Delamination Strength of a sheet sample is measured using a constant rate of extension tensile testing machine such as an Instron table model tester. A 1.0 in. (2.54 cm) by 8.0 in. (20.32 cm) sample is delaminated approximately 1.25 in. (3.18 cm) by inserting a pick into the cross-section of the sample to initiate a separation and delamination by hand. The delaminated sample faces are mounted in the clamps of the tester which are set 1.0 in. (2.54 cm) apart. The tester is started and run at a cross-head speed of 5.0 in./min. (12.7 cm/min.). The computer starts picking up force readings after the slack is removed in about 0.5 in. of crosshead travel. The sample is delaminated for about 6 in. (15.24 cm) during which 3000 force readings are taken and averaged. The average delamination strength is the average force divided by the sample width and is expressed in units of N/cm. The test generally follows the method of ASTM D 2724-87, which is hereby incorporated by reference. The delamination strength values reported for the examples below are each based on an average of at least twelve measurements made on the sheet.

Opacity is measured according to TAPPI T-425 om-91, which is hereby incorporated by reference. The opacity is the reflectance from a single sheet against a black background compared to the reflectance from a white background standard and is expressed as a percent. The opacity values reported for the examples below are each based on an average of at least six measurements made on the sheet.

Print Quality is measured according to ANSI X3.182-1990, which is hereby incorporated by reference. The test measures the print quality of a bar code for purposes of code readability. The test evaluates the print quality of a bar code symbol for contrast, modulation, defects, and decodability and assigns a grade of A, B, C, D or F(fail) for each category. The additional categories of reflectance and edge contrast are evaluated on a pass/fail basis. The overall grade of a sample is the lowest grade received in any of the above categories. The bar code quality numerical values reported in the examples below represent an average of 80 scans, wherein a grade of A=4, a grade of B=3, a grade of C=2, a grade of D=1, and a grade of F=0. For each sample, ten scans were made on eight different bar codes printed on the sample, for a total of 80 scans. The ANSI grades were assigned as follows:

| BAR CODE RATING | A | B | C | D | F |
|---|---|---|---|---|---|
| Symbol Contrast | >70 | >55 | >40 | >20 | <20 |
| Edge Contrast | >15 | | | | <15 |
| Modulation | >70 | >60 | >50 | >40 | <40 |
| Decodability | >62 | >50 | >37 | >25 | <25 |
| Defects | <15 | <20 | <25 | <30 | >30 |

The testing was done with Code 39 symbology bar codes with the narrow bar width of 0.0096 inch (0.0244 cm) that were printed with an Intermec 4400 Printer it manufactured by Intermec Inc. of Cincinnati, Ohio, using thermal transfer ribbon B110A made by Ricoh Electronics of Japan. Verification was done with a PSC Quick Check 200 scanner (660 nm wavelength and 6 mil aperture) manufactured by Photographic Sciences Corporation Inc. of Webster, N.Y.

Melt Index is measured according to ASTM-D-1238-90A and is expressed in units of g/10 minutes (@ 190° C. with a 2.16, 5 or 21.6 kg weight).

Chroma is a unitless measurement of color saturation according to the Munsel System of Color Notation. A higher Chroma value is indicative of a richer, more pure color, regardless of the color's hue. Chroma was measured with a MacBeth Model 2020 integrating sphere spectraphotometer manufactured by MacBeth Division of Kolhmorgen Corporation of Newburgh, N.Y.

Sheet Thickness was determined by ASTM method D 1777, which is hereby incorporated by reference, and is reported in microns.

Sheet Smoothness was measured using an L&W PPS Tester (commonly know as a Parker Tester) manufactured by Lorentzen & Wettre of Kista, Sweden. The test was run according to the following standard methods TAPPI T 555 and ISO 8781-4, which are hereby incorporated by reference. According to the test, the smoothness or roughness of a sheet is measure by pressing the measuring ring of the Parker Tester against the sheet material being tested. A controlled flow of compressed air is injected into a compartment on the inside of the ring that has a side open to the sheet material being tested. Air passing under the ring enters a chamber on the outside of the ring that has a side open to the sheet material being tested. The air collected in the outside chamber is measured over time and this measurement is used to calculate the roughness (or smoothness) of the sheet surface in units of microns.

Tensile Strength was determined by ASTM D 5035-90, which is hereby tincorporated by reference, with the following modifications. In the test a 2.54 cm by 20.32 cm (1 inch by 8 inch) sample was clamped at opposite ends of the sample. The clamps were attached 12.7 cm (5 in) from each other on the sample. The sample was pulled steadily at a speed of 5.08 cm/min (2 in/min) until the sample broke. The force at break was recorded in Newtons/cm as the breaking tensile strength.

Elongation to Break of a sheet is a measure of the amount a sheet stretches prior to failure (breaking)in a strip tensile test. A 1.0 inch (2.54 cm) wide sample is mounted in the clamps—set 5.0 inches (12.7 cm) apart—of a constant rate of extension tensile testing machine such as an Instron table model tester. A continuously increasing load is applied to the sample at a crosshead speed of 2.0 in/min (5.08 cm/min) until failure. The measurement is given in percentage of stretch prior to failure. The test generally follows ASTM D5035-90.

Elmendorf Tear Strength is a measure of the force required to propagate a tear cut in a sheet. The average force required to continue a tongue-type tear in a sheet is determined by measuring the work done in tearing it through a fixed distance. The tester consists of a sector-shaped pendulum carrying a clamp that is in alignment with a fixed clamp when the pendulum is in the raised starting position, with maximum potential energy. The specimen is fastened in the clamps and the tear is started by a slit cut in the specimen between the clamps. The pendulum is released and the specimen is torn as the moving clamp moves away from the fixed clamp. Elmendorf tear strength is measured in Newtons in accordance with the following standard methods: ASTM D 5035-90, which are hereby incorporated by reference.

The tear strength values reported for the examples below are each an average of at least twelve measurements made on the sheet.

Gurley Hill Porosity is a measure of the permeability of the sheet material for gaseous materials. In particular, it is a measure of how long it takes for a volume of gas to pass through an area of material wherein a certain pressure gradient exists. Gurley-Hill porosity is measured in accordance with ASTM D 726-84 using a Lorentzen & Wettre Model 121D Densometer. This test measures the time required for 100 cubic centimeters of air to be pushed through a one inch diameter sample under a pressure of approximately 4.9 inches of water. The result is expressed in seconds and is frequently referred to as Gurley Seconds.

Comparative Example 1

Plexifilamentary polyethylene was flash-spun from a solution consisting of 18.7% of linear high density polyethylene and 81.3% of a spin agent consisting of 32% cyclopentane and 68% normal pentane. The polyethylene had a melt index of 0.70 g/10 minutes (@ 190° C. with a 2.16 kg weight), a melt flow ratio {MI (@ 190° C. with a 2.16 kg weight)/MI (@ 190° C. with a 21.6 kg weight)} of 34, and a density of 0.96 g/cc. The polyethylene was obtained from Lyondell Petrochemical Company of Houston, Tex. under the tradename ALATHON®. ALATHON® is currently a registered trademark of Lyondell Petrochemical Company. The solution was prepared in a continuous mixing unit and delivered at a temperature of 185° C., and a pressure of about 13.8 MPa (2000 psi) through a heated transfer line to an array of six spinning positions. Each spinning position had a pressure letdown chamber where the solution pressure dropped to about 6.2 MPa (900 psi). The solution discharged from each letdown chamber to a region maintained near atmospheric pressure and at a temperature of about 50° C. through a 0.871 mm (0.0343 in) spin orifice. The flow rate of solution through each orifice was about 106 kg/hr (232 lbs/hr). The solution was flash-spun into plexifilamentary film-fibrils that were laid down onto a moving belt, consolidated, and collected as a loosely consolidated sheet on a take-up roll as described above.

The sheet was bonded on a Palmer bonder by passing the sheet between a moving belt and a rotating heated smooth metal drum with a diameter of about 5 feet. A Palmer bonder bonds sheet in a manner similar to the bonder shown in FIG.

2. The drum was heated with pressurized steam and the bonding temperature of the drum was controlled by adjusting the pressure of the steam inside the drum. The pressurized steam heated the bonding surface of the drum to approximately 133° to 137° C. The pressure of the steam was used to adjust the temperature of the drum according to the degree of bonding desired. The bonded sheet had the opacity, delamination strength and bar code readability properties set forth in Table 1.

TABLE 1

| Steam Pressure (KPa) | Basis Weight (g/m2) | Opacity (%) | Delamination Strength (N/m) | Bar Code Readability |
|---|---|---|---|---|
| 324 | 58.3 | 97.8 | 59.5 | 1.2 |
| 338 | 57.3 | 97.7 | 70.1 | 1.4 |
| 352 | 57.6 | 96.4 | 98.1 | 1.7 |
| 372 | 57.3 | 92.3 | 127.8 | 1.8 |
| 386 | 57.0 | 89.4 | 140.1 | 1.2 |
| 400 | 57.6 | 81.7 | 147.1 | |

Example 1

In this Example the polyethylene of Comparative Example 1 was flash-spun under conditions like those described in the Comparative Example 1 with the exception that titanium dioxide was added to the polyethylene before the polyethylene was mixed with the solvent. A concentrate was formed by compounding Type R104 neutralized rutile titanium dioxide into linear low density polyethylene, with a melt index of 3.0 g/10 min at 190° C. and a density of 0.917 g/cc, at 50% on-weight-polymer loading. The titanium dioxide had a mean particle size diameter of about 0.5 microns, and had been sprayed with 1% (by weight of the titanium dioxide) octyl triethoxy silane. This concentrate was obtained in pelletized form from Ampacet Corporation of Tarrytown, N.Y. under the name Pigment White 6 (CI No. 77891). The concentrate was subsequently tumble blended with a quantity of the high density polyethylene used in Comparative Example 1. The resulting mixture was comprised of 95% polyethylene and 5% rutile titanium dioxide. This mixture was added to the solvent of Comparative Example 1 in the same proportions as Comparative Example 1 to form a spin solution. The spin solution was subsequently flash-spun under conditions identical to Comparative Example 1 to produce a consolidated sheet. The sheet was thermally bonded on a Palmer bonder as described in Comparative Example 1. The bonded sheet had the opacity, delamination strength and bar code readability properties set forth in Table 2.

TABLE 2

| Steam Pressure (KPa) | Basis Weight (g/m2) | Opacity (%) | Delamination Strength (N/cm) | Bar Code Readability |
|---|---|---|---|---|
| 324 | 60.0 | 98.5 | 49.0 | 2.5 |
| 338 | 60.0 | 98.1 | 75.3 | 2.5 |
| 352 | 60.4 | 95.5 | 84.1 | 2.6 |
| 372 | 60.0 | 94.3 | 124.3 | 2.6 |
| 386 | 59.7 | 93.1 | 161.1 | 2.5 |

Example 2

In this Example the polyethylene was flash-spun under conditions like those described in the Example 1 with the exception that the titanium dioxide and linear low density polyethylene mixture comprised 97.2% polyethylene and 2.5% rutile titanium dioxide. This mixture was prepared in the manner described in Example 1. This mixture was added to the solvent used in both Comparative Example 1 and Example 1 in the same proportions to form a spin solution. The spin solution was subsequently flash-spun under the conditions used in Comparative Example 1 and Example 1 to produce a consolidated sheet. The sheet was thermally bonded on a Palmer bonder as described in Comparative Example 1. The bonded sheet had the opacity, delamination strength and bar code readability properties set forth in Table 3.

TABLE 3

| Steam Pressure (kPa) | Basis Weight (g/m2) | Opacity (%) | Delamination Strength (N/cm) | Bar Code Readability |
|---|---|---|---|---|
| 324 | 56.6 | 97.9 | 61.3 | 1.6 |
| 338 | 57.6 | 97.6 | 80.6 | 2.2 |
| 352 | 57.3 | 96.5 | 91.1 | 2.4 |
| 372 | 57.3 | 92.1 | 147.1 | 2.0 |
| 386 | 57.0 | 89.5 | 152.4 | 2.0 |

Example 3

In this Example the polyethylene of Comparative Example 1 was flash-spun under conditions like those described in Comparative Example 1 with the exception that blue pigment was added to the polyethylene before the polyethylene was mixed with the solvent. A concentrate consisting of polyethylene and blue pigment was prepared as follows: Pigment Blue 15(CI No. 74160) was compounded into linear low density polyethylene, with a melt index of 2.0 g/10 min at 190° C. and a density of 0.924 g/cc, at a 20% on-weight-polymer loading. This concentrate was obtained in pelletized form from Ampacet under the product name Blue PE590547. The pelletized concentrate was subsequently tumble blended with a quantity of the high density polyethylene used in Comparative Example 1. The resulting mixture was comprised of 99.6% polyethylene and 0.4% Pigment Blue 15. This mixture was added to the solvent of Comparative Example 1 in the same proportions as Comparative Example 1 to form a spin solution. The spin solution was subsequently flash-spun under conditions identical to Comparative Example 1 to produce a consolidated sheet. The sheet was thermally bonded on a Palmer bonder as described in Comparative Example 1. The bonded sheet had the opacity, delamination strength and chroma properties set forth in Table 4.

TABLE 4

| Steam Pressure (kPa) | Basis Weight (g/m2) | Delamination Strength (N/m) | Opacity (%) | Chroma |
|---|---|---|---|---|
| unbonded | 51.9 | NA | 100 | 22.7 |
| 310 | 55.3 | 50.8 | 100 | 27.7 |
| 324 | 56.3 | 82.3 | 100 | 29.9 |
| 338 | 57.3 | 98.1 | 99.9 | 33.6 |
| 352 | 58.3 | 134.8 | 99.6 | 35.5 |
| 372 | 58.0 | 173.4 | 98.64 | 35.8 |
| 386 | 57.6 | 190.9 | 98.02 | 36.1 |
| 400 | 58.0 | 199.6 | 97.06 | 37.2 |

Example 4

In this Example the polyethylene of Comparative Example 1 was flash-spun under conditions like those described in Comparative Example 1 with the exception that red pigment was added to the polyethylene before the polyethylene was mixed with the solvent. A concentrate consisting of polyethylene and red pigment was compounded as follows: 29% Pigment Red 53(CI No. 15585), 12% Pigment Red 48(CI No. 15865) and 9% Pigment White 6(CI No. 77891), and 50% low density polyethylene, with a melt index of 8.0 g/10 min at 190° C. and a density of 0.918 g/cc. The concentrate was obtained in pelletized form from Ampacet under product name Red PE 15151. The pelletized concentrate was subsequently tumble blended with a quantity of the high density polyethylene used in Comparative Example 1. The resulting mixture was comprised of 98% polyethylene, 1.16% Pigment Red 53, 0.48% Pigment Red 48 and 0.36% Pigment White 6. This mixture was added to the solvent of Comparative Example 1 in the same proportions as Comparative Example 1 to form a spin solution. The spin solution was subsequently flash-spun under conditions identical to Comparative Example 1 to produce a consolidated sheet. The sheet was thermally bonded on a Palmer bonder as described in Comparative Example 1. The bonded sheet had the opacity, delamination strength and chroma properties set forth in Table 5.

TABLE 5

| Steam Pressure (KPa) | Basis Weight (g/m2) | Delamination Strength (N/m) | Opacity (%) | Chroma |
|---|---|---|---|---|
| unbonded | 55.3 | NA | 100 | 27.8 |
| 310 | 68.5 | 54.3 | 99.8 | 37.2 |
| 324 | 60.7 | 64.8 | 99.9 | 40.4 |
| 338 | 58.7 | 80.6 | 99.7 | 43.2 |
| 352 | 60.0 | 98.3 | 99.3 | 46.6 |
| 372 | 61.0 | 126.1 | 98.5 | 47.3 |
| 386 | 59.7 | 131.3 | 97.8 | 47.6 |
| 400 | 57.0 | 182.1 | 95.5 | 49.2 |

Example 5

In this Example the polyethylene of Comparative Example 1 was flash-spun under conditions like those described in Comparative Example 1 with the exception that yellow pigment was added to the polyethylene before the polyethylene was mixed with the solvent. A concentrate consisting of polyethylene and yellow pigment was compounded as follows: 24% Pigment Yellow 138(CI No. 56300), 6% Pigment White 6(CI No. 77891) and 1% Pigment Yellow 110(CI No. 56280), and 69% linear low density polyethylene, with a melt index of 20.0 g/10 min at 190° C. and a density of 0.920 g/cc. The concentrate was obtained in pelletized form from Ampacet under the product name Safety Yellow 430191. The concentrate was subsequently tumble blended with a quantity of the high density polyethylene used in Comparative Example 1. The resulting mixture was comprised of 98.76% polyethylene, 0.96% Pigment Yellow 138, 0.24% Pigment White 6 and 0.04% Pigment Yellow 110. This mixture was added to the solvent of Comparative Example 1 in the same proportions as Comparative Example 1 to form a spin solution. The spin solution was subsequently flash spun under conditions identical to Comparative Example 1 to produce a consolidated sheet. The sheet was thermally bonded on a Palmer bonder as described in Comparative Example 1. The bonded sheet had the opacity, delamination strength and chroma properties set forth in Table 6.

TABLE 6

| Steam Pressure (KPa) | Basis Weight ($g/m^2$) | Delamination Strength (N/m) | Opacity (%) | Chroma |
|---|---|---|---|---|
| unbonded | 54.6 | NA | 99.0 | 27.8 |
| 310 | 56.3 | 50.8 | 99.2 | 39.0 |
| 324 | 60.0 | 75.3 | 94.7 | 46.1 |
| 338 | 58.0 | 98.1 | 96.9 | 51.4 |
| 352 | 60.4 | 117.3 | 94.4 | 55.4 |
| 372 | 58.3 | 159.4 | 91.5 | 59.1 |
| 386 | 59.7 | 189.1 | 87.5 | 59.9 |
| 400 | 58.0 | 206.6 | 87.6 | 57.3 |

Example 6

Plexifilamentary polyethylene was flash-spun from a solution of polyethylene and trichlorofluoromethane. The polyethylene was high density polyethylene with a melt index of 0.74 g/10 minutes (@ 190° C. with a 2.16 kg weight), a melt flow ratio {MI (@ 190° C. with a 2.16 kg weight)/MI (@ 190° C. with a 21.6 kg weight)} of 42, and a density of 0.955 g/cc. The polyethylene was obtained from Lyondell Petrochemical Company of Houston, Tex. under the tradename ALATHON® 7026T.

A black pigment was added to the polyethylene before the polyethylene was added to the trichlorofluoromethane solvent. A pelletized concentrate of polyethylene and black pigment was obtained from Ampacet under the product name Black PE 460637. The compound consisted of 10% Pigment Black 7(CI No. 77226) and 90% high density polyethylene, with a melt index of 0.7 g/10 min at 190° C. and a density of 0.955 g/cc. This concentrate was subsequently tumble blended with a quantity of the high density polyethylene described in the paragraph above. The resulting mixture was comprised of 99.9% polyethylene and 0.1% Pigment Black 7. This mixture was added to the trichlorofluoromethane solvent to form a spin solution of 11% pigmented polyethylene and 89% solvent. The spin solution was prepared in a continuous mixing unit and delivered at a temperature of 190° C., and a pressure of about 13.8 MPa (2000 psi) through a heated transfer line to a pressure letdown chamber where the solution pressure dropped to 8.1 MPa (1180 psi). The solution discharged from the letdown chamber to a region maintained near atmospheric pressure and at 49° C. through one of a linear array of 1.67 mm (0.0656 in) spin orifices. The flow rate of solution through each orifice was about 647 kg/hr (1427 lbs/hr). The solution was flash-spun into plexifilamentary film-fibrils that were laid down onto a moving belt, consolidated to form a sheet, and collected on a take-up roll as described above.

Next the loosely consolidated sheet was embossed and thermally bonded.

The sheet was wrapped about 203° around a first rotating 20 inch (50.8 cm) embossing roll that was heated with hot oil to a temperature between 160° and 190° C. and had a fine linen pattern engraved on its surface. The sheet was passed through a 1.25 inch (3.18 mm) nip with a pressure of 600 psi (4.14 kPa) that was formed between the first heated embossing roll and a resilient back-up roll. The sheet was next wrapped about 203° around a second rotating 20 inch (50.8 cm) embossing roll that was heated with hot oil to a temperature between 1600 and 190° C. and had a pattern of small ribs engraved on its surface. The sheet was passed through a 1.25 inch (3.18 mm) nip with a pressure of 600 psi (4.14 kPa) formed between the second heated embossing roll and a resilient back-up roll before being transferred to a pin softening apparatus. The pin softening apparatus comprised two sets of two 14 inch (35.57 mm) diameter rolls covered with 0.040 inch (0.102 mm) diameter pins set on a square 0.125 inch (0.318 mm) pattern. The bonded and embossed sheet was passed between the pin rolls of each set. The pin rolls were set so that the pins from one roll of each roll set pushed between the pins of the other roll of the set, with the pin engagement being typically about 0.045 inches (0.102 mm). The bonded and softened sheet had the following properties:

| | |
|---|---|
| Basis Weight | 40.7 g/m$^2$ |
| Opacity | 100% |
| Chroma | 1.0 |

Comparative Example 2

In this Example the polyethylene of Example 6 was flash-spun under the conditions described in the Example 6 with the exception that no pigment was added to the polyethylene before the polyethylene was mixed with the solvent. The bonded and softened sheet had the following properties:

| | |
|---|---|
| Basis Weight | 40.7 g/m$^2$ |
| Opacity | 96.0% |
| Chroma | 0.4 |

Comparative Examples 3–5

Plexifilamentary polyethylene film fibrils were flash-spun from a solution of polyethylene and trichlorofluoromethane spin agent. The polyethylene was high density polyethylene with a melt index of 2.3 g/10 minutes (@ 190° C. with a 5 kg weight), a melt flow ratio {MI (@ 190° C. with a 21.6 kg weight)/MI (@ 190° C. with a 5 kg weight)} of 11, and a density of 0.956 g/cc. The polyethylene was obtained from Hostalen GmbH of Frankfiurt, Germany, under the tradename HOSTALEN.

The polyethylene was added in pellet form to the trichlorofluoromethane spin agent to form a spin solution of 11.4% polyethylene and 88.6% spin agent. The spin solution was prepared in a continuous mixing unit and delivered at a temperature of 181° C., and a pressure of about 13.3 MPa (1925 psi) through a heated transfer line to a pressure letdown chamber where the solution pressure dropped to about 6.3 MPa (914 psi). The solution discharged from the letdown chamber to a region maintained near atmospheric pressure and at about 42° C. through one of a linear array of sixty-four 1.43 mm (56.2 mil) spin orifices. The flow rate of the solution through each orifice was about 440 kg/hr (965 lbs/hr). The solution was flash-spun into plexifilamentary film-fibrils that were laid down onto a moving belt, consolidated to form a 2.92 meter (115 inch) wide sheet, and collected on a take-up roll as described above. The basis weight of the sheet was adjusted by adjusting the speed of the belt (line speed) onto which the plexifilamentary material was laid down.

Next, the loosely consolidated sheet was thermally bonded. The consolidated sheet was thermally whole-surface bonded on each side using large drum (2.7 m diameter) bonders like the bonder described in U.S. Pat. No. 3,532,589 to David. The bonding drum was heated with steam, and the steam pressure and sheet speed were adjusted so as to obtain a sheet delamination strength of about 0.79 N/cm (0.45 lb/in). The sheet material of Comparative Examples 3–5 had a basis weight of about 74.2 g/m$^2$ (2.2 oz/yd$^2$) and was bonded at a sheet speed of 130 m/min with a bonder steam pressure of 505 kPa (73.2 psi). The bonded sheets were corona treated on each side at a watt density in the range of 0.0210 to 0.0244 Watt-min/ft$^2$ in order to improve the adhesion of printing ink to the sheet. An antistatic treatment of a potassium butyl phosphate acid ester (ZELEC®-TY sold by DuPont) was applied as an aqueous solution and hot air dried to a weight of 45 milligrams/m$^2$.

The sheet of Comparative Example 3 was tested without further treatment. The bonded sheet of Comparative Example 4 was slit into 60 inch (1.52 m) wide rolls and then subjected to cold calendering. The bonded sheet of Comparative Example 5 was subjected to a hot calendering.

The cold calendering was done on a Beloit Super Calender with an 18 inch (45.7 cm) diameter steel roll that was maintained at 100° F. (37.8° C.). The steel roll had a surface roughness of about 20 microinches (0.51 microns). The sheet was wrapped on the steel roll with the smoother side of the sheet (side that faced the second bonding drum during bonding) facing the steel roll. The sheet was then passed through a calender nip formed between the steel roll and a hard cotton-filled backup roll having a 90 Shore D Hardness. The nip pressure was maintained at 580 lb/linear inch (1015.7 N/linear cm). The side of the calendered sheet that faced the steel roll was the side that was tested for smoothness and printed with a bar code for bar code scanability testing.

The hot calendering was done on a Thermal Calender Printer made by B. F. Perkins, a division of Roehlen Industries of Rochester, N.Y., with a 24 inch (61 cm) diameter steel roll that was maintained at 275° F. (135° C.). The steel roll had a surface roughness of about 8 microinches (0.20 microns). The sheet was wrapped on the steel roll with the smoother side of the sheet (side that faced the second bonding drum during bonding) facing the steel roll. The sheet was then passed through a calender nip formed between the steel roll and a resilient rubber backup roll having a 90 Shore A Hardness. The nip pressure was maintained at 500 lb/linear inch (875.6 N/linear cm). The side of the calendered sheet that faced the steel roll was the side that was tested for smoothness and printed with a bar code for bar code scanability testing.

The bonded sheets of Examples 3–5 were each printed with a bar code pattern as described in the Print Quality test method described above. The sheets were also tested for strength, elongation, opacity, and burst strength according to the test methods described above. The sheet properties for the uncalendered sheet (Comparative Example 3) are set forth in Table 7 below. The sheet properties for the cold calendered sheet (Comparative Example 4) are set forth in Table 8 below. The sheet properties for the hot calendered sheet (Comparative Example 5) are set forth in Table 9 below.

Examples 7–12

In Examples 7–12, polyethylene plexifilamentary film fibril sheets were flash-spun and bonded as described in Comparative Examples 3–5 with the exception that the titanium dioxide of Example 1 was added to the polyethylene before the polyethylene was mixed with the solvent.

In Examples 7–9, a concentrate was formed by compounding Type R104 neutralized rutile titanium dioxide into the high density polyethylene of Comparative Examples 3–5 at 50% on-weight-polymer loading. This concentrate was obtained in pelletized form from Ampacet Europe S.A. of Messancy, Belgium under the name White HDPE MB 510710. The concentrate was subsequently tumble blended with the polyethylene of Comparative Examples 3–5 to form a mixture comprised of 96% polyethylene and 4% rutile titanium dioxide. This mixture was added to the spin agent of Comparative Examples 3–5 in the same proportions as Comparative Example 3–5 to form a spin solution. The spin solution was subsequently flash-spun under conditions identical to Comparative Examples 3–5, with the exception that the pressure in the letdown chamber was raised slightly to 6.4 MPa (928 psi), to produce a consolidated sheet.

In Examples 10–12, a concentrate was formed by compounding Type R104 neutralized rutile titanium dioxide into the high density polyethylene of Comparative Examples 3–5 at 50% on-weight-polymer loading. This concentrate was obtained in pelletized form from Ampacet Europe S.A. of Messancy, Belgium under the name White HDPE MB 510710. The concentrate was subsequently tumble blended with the polyethylene of Comparative Examples 3–5 to form a mixture comprised of 92% polyethylene and 8% rutile titanium dioxide. This mixture was added to the spin agent of Comparative Examples 3–5 in the same proportions as Comparative Example 3–5 to form a spin solution. The spin solution was subsequently flash-spun under conditions identical to Comparative Examples 3–5, with the exception that the pressure in the letdown chamber was raised slightly to 6.5 MPa (943 psi), to produce a consolidated sheet.

The consolidated sheet of Examples 7–12 was thermally bonded as described in Comparative Examples 3–5. The bonded sheet of Example 7 was tested without further treatment. The bonded sheet of Example 8 was slit into 60 inch (1.52 m) wide rolls and then subjected to cold calendering as described in Comparative Example 4. The bonded sheet of Example 9 was subjected to a hot calendering as described in Comparative Example 5. The sheet properties for the uncalendered sheet of Example 7 are set forth in Table 7 below. The sheet properties for the cold calendered sheet of Example 8 are set forth in Table 8 below. The sheet properties for the hot calendered sheet of Example 9 are set forth in Table 9 below.

The bonded sheet of Example 10 was tested without further treatment. The bonded sheet of Example 11 was slit into 60 inch (1.52 m) wide rolls and then subjected to cold calendering as described in Comparative Example 4. The bonded sheet of Example 12 was subjected to a hot calendering as described in Comparative Example 5. The sheet properties for the uncalendered sheet Example 10 are set forth in Table 7 below. The sheet properties for the cold calendered sheet of Example 11 are set forth in Table 8 below. The sheet properties for the hot calendered sheet of Example 12 are set forth in Table 9 below.

TABLE 7

| No Calendering | Comp Ex. 3 | Ex. 7 | Ex. 10 |
|---|---|---|---|
| TiO2 wt. % in polyethylene | 0 | 4 | 8 |
| Calendering Conditions | | | |
| Steel Roll Temp. (° C.) | — | — | — |
| Nip Pressure (N/1linear cm) | — | — | — |
| Sheet Speed (m/min.) | — | — | — |

TABLE 7-continued

| No Calendering | Comp Ex. 3 | Ex. 7 | Ex. 10 |
|---|---|---|---|
| Physical Properties | | | |
| Basis Weight (g/m$^2$) | 78.0 | 74.6 | 66.1 |
| Thickness (microns) | 188 | 183 | 170 |
| Smoothness-Parker Tester (microns) | 5.82 | 5.84 | 5.31 |
| Gurley Hill Porosity (seconds) | 22.5 | 18.1 | 15 |
| Opacity (%) | 92.8 | 95.3 | 95.2 |
| Delamination (N/m) | 91 | 123 | 100 |
| Tensile Strength MD (N/cm) | 82.7 | 76.7 | 75.5 |
| Tensile Strength XD (N/cm) | 115.8 | 99.6 | 82.8 |
| Elongation MD (%) | 24.8 | 25.9 | 30.7 |
| Elongation XD (%) | 31.7 | 30.5 | 31.4 |
| Elmendorf Tear MD (N/m) | 154 | 126 | 77 |
| Elmendorf Tear XD (N/m) | 201 | 124 | 140 |
| Bar Code Readability | | | |
| Symbol Contrast (%) | 90/89 | 86/84 | 85/84 |
| Edge Contrast (%) | 41/41 | 50/53 | 53/52 |
| Modulation (%) | 45/46 | 58/63 | 62/64 |
| Decodability (%) | 60/57 | 62/63 | 60/61 |
| Defects (%) | 19/18 | 19/19 | 23/21 |
| Overall ANSI Grade | D/D | C/B | C/C |

TABLE 8

| Cold Calendering | Comp. Ex. 4 | Ex. 8 | Ex. 11 |
|---|---|---|---|
| TiO2 wt. % in polyethylene | 0 | 4 | 8 |
| Calendering Conditions | | | |
| Steel Roll Temp. (° C.) | 37.8 | 37.8 | 37.8 |
| Nip Pressure (N/linear cm) | 1015.7 | 1015.7 | 1015.7 |
| Sheet Speed (m/min.) | 152.4 | 152.4 | 152.4 |
| Physical Properties | | | |
| Basis Weight (g/m$^2$) | 78.3 | 71.9 | 74.6 |
| Thickness (microns) | 132 | 127 | 119 |
| Smoothness-Parker Tester (microns) | 3.41 | 3.27 | 2.72 |
| Gurley Hill Porosity (seconds) | 82.3 | 47.3 | 31.3 |
| Opacity (%) | 92 | 93.7 | 94.8 |
| Delamination (N/m) | 100 | 123 | 81 |
| Tensile Strength MD (N/cm) | 90.5 | 101.6 | 83.5 |
| Tensile Strength XD (N/cm) | 104.4 | 87.9 | 88.4 |
| Elongation MD (%) | 26.9 | 28.2 | 27.3 |
| Elongation XD (%) | 29.1 | 32.2 | 29.1 |
| Elmendorf Tear MD (N/m) | 168 | 105 | 68 |
| Elmendorf Tear XD (N/m) | 162 | 129 | 138 |
| Bar Code Readability | | | |
| Symbol Contrast (%) | 80 | 83 | 82 |
| Edge Contrast (%) | 37 | 55 | 57 |
| Modulation (%) | 46 | 65 | 69 |
| Decodability (%) | 55 | 65 | 64 |
| Defects (%) | 20 | 20 | 21 |
| Overall ANSI Grade | D | B | C |

TABLE 9

| Hot Calendering | Comp. Ex. 5 | Ex. 9 | Ex. 12 |
|---|---|---|---|
| TiO2 wt. % in polyethylene | 0 | 4 | 8 |
| Calendering Conditions | 135 | 135 | 135 |
| Steel Roll Temp. (° C.) | 875.6 | 875.6 | 875.6 |
| Nip Pressure (N/linear cm) | 114.3 | 114.3 | 114.3 |
| Sheet Speed (m/min.) | | | |
| Physical Properties | | | |
| Basis Weight (g/m$^2$) | 78.0 | 71.2 | 66.1 |
| Thickness (microns) | 154 | 147 | 130 |
| Smoothness-Parker Tester (microns) | 3.22 | 3.3 | 3.38 |
| Gurley Hill Porosity (seconds) | 29.9 | 34.1 | 37.8 |
| Opacity (%) | 90.6 | 92.4 | 95.5 |
| Delamination (N/m) | 84 | 123 | 84 |
| Tensile Strength MD (N/cm) | 91.8 | 84.9 | 78.5 |
| Tensile Strength XD (N/cm) | 93.5 | 99.8 | 80.0 |
| Elongation MD (%) | 25.9 | 25.2 | 32.2 |
| Elongation XD (%) | 37.4 | 32.7 | 30.1 |
| Elmendorf Tear MD (N/m) | 152 | 109 | 130 |
| Elmendorf Tear XD (N/m) | 193 | 121 | 130 |
| Bar Code Readability | | | |
| Symbol Contrast (%) | 87 | 85 | 85 |
| Edge Contrast (%) | 43 | 55 | 58 |
| Modulation (%) | 49 | 64 | 68 |
| Decodability (%) | 59 | 61 | 62 |
| Defects (%) | 18 | 19 | 19 |
| Overall ANSI Grade | D | B | B |

Examples 13–21

Plexifilamentary polyethylene film fibrils were flash-spun from a solution of polyethylene and trichlorofluoromethane spin agent. The polyethylene was high density polyethylene with a melt index of 2.3 g/10 minutes (@ 190° C. with a 5 kg weight), a melt flow ratio {MI (@ 190° C. with a 21.6 kg weight)/MI (@ 190° C. with a 5 kg weight)} of 11, and a density of 0.956 g/cc. The polyethylene was obtained from Hostalen GmbH of Frankfurt, Germany, under the tradename HOSTALEN.

The titanium dioxide of Example 1 was added to the polyethylene before the polyethylene was mixed with the spin agent. A concentrate was formed by compounding Type R104 neutralized rutile titanium dioxide into the high density polyethylene of Comparative Examples 3–5 at 50% on-weight-polymer loading. This concentrate was obtained in pelletized form from Ampacet Europe S.A. of Messancy, Belgium under the name White HDPE MB 510710. The concentrate was subsequently tumble blended with the polyethylene of Comparative Examples 3–5 to form a mixture comprised of 96% polyethylene and 4% rutile titanium dioxide. This mixture was added to the spin agent of Comparative Examples 3–5 in the same proportions as Comparative Example 3–5 to form a spin solution (11.4% polyethylene/titanium dioxide mixture and 88.6% spin agent). The spin solution was subsequently flash-spun under conditions identical to Comparative Examples 3–5, with the exception that the pressure in the letdown chamber was raised slightly to 6.4 MPa (928 psi), to produce a consolidated sheet. The basis weight of the sheet was adjusted by adjusting the speed of the belt (line speed) onto which the plexifilamentary material was laid down.

Next, the loosely consolidated sheet was thermally bonded. The consolidated sheet was thermally whole-surface bonded on each side using large drum (2.7 m diameter) bonders like the bonder described in U.S. Pat. No. 3,532,589 to David. The bonding drum was heated with steam, and the steam pressure and sheet speed were adjusted so as to obtain a sheet delamination strength of about 0.79 N/cm (0.45 lb/in). The sheet material of Examples 13–21 were bonded under the following conditions:

| Examples | Target Basis Weight | Sheet Speed | Bonder Steam Pressure |
|---|---|---|---|
| 13, 14 | 54 g/m$^2$ | 160 m/min | 500 kPa |
| 15, 16 | 63 g/m$^2$ | 140 m/min | 500 kPa |
| 17, 18, 19 | 75 g/m$^2$ | 130 m/min | 505 kPa |
| 20, 21 | 102 g/m$^2$ | 110 m/min | 545 kPa |

The bonded sheets were corona treated on each side at a watt density in the range of 0.0210 to 0.0244 Watt-min/ft$^2$ in order to improve the adhesion of printing ink to the sheet. An antistatic treatment of a potassium butyl phosphate acid ester (ZELEC®-TY sold by DuPont) was applied as an aqueous solution and hot air dried to a weight of 45 milligrams/m$^2$.

The bonded sheet of Example 13, 15, 17, and 20 was tested without further treatment. The bonded sheet of Examples 14, 16, 18, and 21 was slit into 60 inch (1.52 m) wide rolls and then subjected to cold calendering as described in Comparative Example 4. The bonded sheet of Example 19 was subjected to a hot calendering as described in Comparative Example 5. The bonded sheets of Examples 13–21 were each printed with a bar code pattern as described in the Print Quality test method described above. The sheets were also tested for strength, elongation, opacity, and burst strength according to the test methods described above. The sheet properties are set forth in Table 10 below.

TABLE 10

| Example | 13 | 14 | 15 | 16 | 17 | 18 | 19 | 20 | 21 |
|---|---|---|---|---|---|---|---|---|---|
| Basis weight (g/m$^2$) | 53.2 | 53.6 | 63.1 | 62.7 | 71.5 | 72.9 | 69.6 | 97.6 | 98.3 |
| TiO2 wt. % in the polyethylene | 4 | 4 | 4 | 4 | 4 | 4 | 4 | 4 | 4 |
| Line Speed (m/min) | 335 | 335 | 290 | 290 | 258 | 258 | 258 | 190 | 190 |
| Calendering Conditions | | | | | | | | | |
| Calender Type | None | Cold | None | Cold | None | Cold | Hot | None | Cold |
| Steel Roll Temp. (° C.) | — | 37.8 | — | 37.8 | — | 37.8 | 135 | — | 37.8 |
| Nip Pressure (N/linear cm) | — | 1015.7 | — | 1015.7 | — | 1015.7 | 875.6 | — | 1015.7 |
| Line Speed (m/min.) | — | 152.4 | — | 152.4 | — | 152.4 | 114.3 | — | 152.4 |
| Physical Properties | | | | | | | | | |
| Thickness (microns) | 138 | 116 | 145 | 117 | 168 | 137 | 147 | 218 | 157 |
| Smoothness-Parker Tester (microns) | 5.6 | 3.7 | 5.59 | 3.56 | 5.57 | 3.82 | 3.3 | 6.27 | 4.28 |

TABLE 10-continued

| Example | 13 | 14 | 15 | 16 | 17 | 18 | 19 | 20 | 21 |
|---|---|---|---|---|---|---|---|---|---|
| Gurley Hill Porosity (seconds) | 8.0 | 17.0 | 11.9 | 15.4 | 16.1 | 27.3 | 34.1 | 20.4 | 52 |
| Opacity (%) | 93.1 | 90.4 | 93.9 | 93.5 | 95.4 | 94.9 | 92.4 | 97.4 | 92.1 |
| Delamination (N/m) | 92.8 | 80.6 | 82.3 | 91.1 | 91.1 | 87.6 | 122.6 | 91.1 | 148.9 |
| Tensile Strength MD (N/cm) | 56.0 | 54.6 | 67.6 | 74.8 | 76.0 | 80.9 | 84.9 | 110.6 | 116.8 |
| Tensile Strength XD (N/cm) | 60.2 | 60.1 | 82.5 | 80.6 | 94.9 | 94.9 | 99.8 | 134.1 | 132.0 |
| Elongation MD (%) | | 22.7 | | 28.8 | | 26.7 | 25.2 | | 34.0 |
| Elongation XD (%) | | 25.7 | | 29.4 | | 33.2 | 32.7 | | 33.2 |
| Elmendorf Tear MD (N/m) | 99.8 | 126.1 | 98.1 | 136.6 | 101.6 | 162.9 | 108.6 | 122.6 | 147.1 |
| Elmendorf Tear XD (N/m) | 131.3 | 134.8 | 127.8 | 133.1 | 126.1 | 169.9 | 120.8 | 152.4 | 166.4 |
| Bar Code Readability | | | | | | | | | |
| Symbol Contrast (%) | 83 | 81 | 84 | 82 | 85 | 86 | 85 | 87 | 87 |
| Edge Contrast (%) | 44 | 51 | 44 | 52 | 47 | 56 | 55 | 45 | 55 |
| Modulation (%) | 53 | 62 | 52 | 63 | 54 | 64 | 64 | 51 | 63 |
| Decodability (%) | 60 | 60 | 54 | 64 | 59 | 65 | 61 | 51 | 64 |
| Defects (%) | 20 | 17 | 21 | 19 | 21 | 19 | 19 | 20 | 18 |
| Overall ANSI Grade | C | B | C | B | C | B | B | C | B |

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

What is claimed is:

1. A nonwoven fibrous sheet comprised of continuous lengths of bonded plexifilamentary fibril strands of a polyolefin polymer and a pigment wherein the polyolefin comprises at least 90% by weight of the fibril strands, the pigment comprises between 0.05% and 10% by weight of the fibril strands, the sheet has a first surface, and the sheet has a basis weight of less than 130 g/m$^2$, a Parker Tester Smoothness of less than 4.8 microns on the first surface of the sheet, a bar code readability, according to ANSI Standard X3.182-1990, of at least 2.0 on the first surface of the sheet, and an opacity of at least 92% if the sheet has a delamination strength less than 150 N/m, and an opacity of at least 80% if the sheet has a delamination strength greater than 150 N/m.

2. The nonwoven fibrous sheet of claim 1 wherein the sheet has a delamination strength of at least 70 N/cm.

3. The sheet of claim 2 wherein said polyolefin polymer is selected from the group consisting of polyethylene, polypropylene, and copolymers comprised primarily of ethylene and propylene units.

4. The sheet of claim 3 wherein said polyolefin is polyethylene.

5. The sheet of claim 1 wherein at least 85% of said pigment is titanium dioxide.

6. The sheet of claim 5 wherein said titanium dioxide comprises particles of rutile titanium dioxide having an average particle size of less than 0.75 microns.

7. The sheet of claim 6 wherein the titanium dioxide has a coating of about 0.1 to about 5% by weight, based on the weight of the titanium dioxide, of at least one organosilicon compound having the formula: RxSi(R')4−x wherein R is a nonhydrolyzable aliphatic, cycloaliphatic or aromatic group having 8–20 carbon atoms;

R' is a hydrolyzable group selected from alkoxy, halogen, acetoxy or hydroxy or mixtures thereof; and x=1 to 3.

8. The sheet of claim 1 wherein said sheet has a bar code readability, according to ANSI Standard X3.182-1990, of at least 3.0.

9. The sheet of claim 5 wherein titanium dioxide comprises between 2% and 6% by weight of the fibril strands.

* * * * *